US005805407A

United States Patent [19]

Takano et al.

[11] Patent Number: 5,805,407

[45] Date of Patent: Sep. 8, 1998

[54] CHARGE ELIMINATING APPARATUS FOR A MOVING WEB

[75] Inventors: Kozo Takano; Yasuhisa Tazawa; Kenji Kojima, all of Minami-ashigara, Japan

[73] Assignee: Fuji Photo Film Co., Ltd., Kanagawa, Japan

[21] Appl. No.: 708,611

[22] Filed: Sep. 5, 1996

[30] Foreign Application Priority Data

Sep. 7, 1995 [JP] Japan ..... 7-230358

[51] Int. Cl.[6] ..... H05F 3/04

[52] U.S. Cl. ..... 361/214; 361/220

[58] Field of Search ..... 361/212, 213, 361/214, 220, 221, 222

[56] References Cited

U.S. PATENT DOCUMENTS

| | | | |
|---|---|---|---|
| 3,281,347 | 10/1966 | Winder | 361/214 |
| 3,474,292 | 10/1969 | Carter | 317/2 |
| 3,483,374 | 12/1969 | Erben | 361/213 |
| 3,543,023 | 11/1970 | Yellin et al. | 317/262 |
| 3,716,755 | 2/1973 | Marx | 361/221 |
| 3,730,753 | 5/1973 | Kerr | 361/213 |
| 3,757,163 | 9/1973 | Gibbons et al. | 361/213 |
| 3,790,854 | 2/1974 | Dryczynski et al. | 361/213 |
| 4,046,842 | 9/1977 | Groves et al. | 361/213 |
| 4,402,035 | 8/1983 | Kisler | 361/213 |
| 4,517,143 | 5/1985 | Kisler | 361/213 |
| 4,810,432 | 3/1989 | Kisler | 361/213 |
| 5,041,941 | 8/1991 | Carter et al. | 361/225 |
| 5,432,454 | 7/1995 | Durkin | 324/452 |

FOREIGN PATENT DOCUMENTS

| | | | |
|---|---|---|---|
| 0136606 | 4/1985 | European Pat. Off. | G05F 3/04 |
| 2106420 | 9/1971 | France | H05F 3/00 |
| 2147997 | 7/1972 | France | B29D 7/00 |
| 2287986 | 10/1975 | France | B28D 7/26 |
| 55-15278 | 4/1980 | Japan | H05F 3/04 |
| 2090547 | 4/1985 | United Kingdom | B03C 3/60 |

OTHER PUBLICATIONS

Research Disclosure, No. 169, May 1978, pp. 59–59, XP002020986 R. Gucwa et al.: "Method for Regulating Web Charge", figure 1.

*Primary Examiner*—Fritz Fleming
*Attorney, Agent, or Firm*—Sughrue, Mion, Zinn, Macpeak & Seas, PLLC

[57] ABSTRACT

Charge eliminating apparatus for a moving web comprising two voltage applicators with discharge electrodes arranged at uniform intervals is disclosed. The voltage applicators are provided against the web supported by a backing roller or two backing rollers. The distance between each voltage applicators is settled to be small, and the discharge electrodes are connected to high voltage power sources. By applying D.C. voltage to the web, electrostatic charges on the web are efficiently eliminated.

17 Claims, 10 Drawing Sheets

CHARGE ELIMINATING APPARATUS FOR A MOVING WEB

BACKGROUND OF THE INVENTION

1. Field of the Invention

The present invention relates to a charge eliminating apparatus for a moving web, and more particularly to a charge eliminating apparatus for a moving web for eliminating electrostatic charge on the surface, of the moving web which is composed of paper, plastic sheet, or the like.

2. Description of the Related Art

The conventional charge eliminating apparatus are disclosed in a Japanese Utility Model Publication No. 55-15278.

The charge eliminating apparatus for dielectric materials in the Japanese Utility Model Publication No. 55-15278 is provided with a plurality of pin-shaped discharge electrodes. This apparatus applies the A.C. voltage to the discharge electrodes, and generates the corona discharge from each discharge electrode to irradiate positive and negative ions toward the dielectric material. As a result, the positive and negative ions on the material neutralize the ions of reverse polarity, so that the charge of the material is eliminated.

GB 2090547 B which corresponds to the Japanese Patent Application Laid-open No. 57-128498 discloses a discharge electrode that has a plurality of tips as a brush using electrically low conductive materials. The brush generates the corona discharge from the tip thereof, and applies the ions to the web.

According to a conventional charge eliminating apparatus 8 for the web (see FIG. 9), the ions 6 . . . are applied to only one side of the web 1. Therefore, when the electric force of the ions 6 is in a direction to get away from the web 1, the ions are neutralized. However, when the ions 7 pull each other at both sides of the web 1, the ions cannot be neutralized even if the negative and positive ions are irradiated by the discharge electrodes. Thus, as shown in FIG. 10, there is a problem in that the charge of the web cannot be eliminated sufficiently. Incidentally, $G_1$ is a graph showing a static electrification voltage of the web before using the charge eliminating apparatus 8 in the Utility Model Publication No. 55-15278. $G_2$ is a graph showing the static electrification voltage of the web after using it. In the case of the conventional charge eliminating apparatus, there is little difference in effect before and after using the apparatus.

The electrodes disclosed in GB 2090547 B uses the brush as a discharge electrode. When the brush is used, there is a problem in that the irregularity of the charge occurs on the web. Moreover, since the discharge centers on the tip of the brush, the irregularity of charge can occur easily, and the corrosion and deterioration can occur rapidly at the tip of the brush.

SUMMARY OF THE INVENTION

The present invention has been developed in view of the above-described circumstances, and has its object the provision of a charge eliminating apparatus for a moving web, which prevents the irregularity in the discharge of the web, improves the charging efficiency, prevents the floating matter in the air from adhering to the web, improves the durability and simplifies the maintenance, and saves the space for placing the charge eliminating apparatus.

In order to achieve the above-described objects, a first voltage applying means and a second voltage applying means are provided against a moving web supported by a backing roller or two backing rollers. These two voltage applying means have discharge electrodes arranged at uniform intervals with predetermined gaps against the web supported by the circumferential surface of a backup roller (s), which is rotatably held in a state of being grounded. The distance between the first voltage applying means and the second voltage applying means is settled to be small so as to prevent the charge potential of the web from rising too high.

According to the present invention, the discharge electrodes of the first voltage applying means and the second voltage applying means are arranged at uniform intervals with predetermined gaps against the web supported by the circumferential surface of the backup roller(s). If a pair of applying means are provided like this, the ions can be neutralized sufficiently.

Moreover, according to the present invention, the distance between the first voltage applying means and the second voltage applying means is settled to be small so as to prevent the charge potential of the web from rising too high. Thus, when the web moves from the first voltage applying means to the second voltage applying means, the positive and negative ions on the web can be prevented from becoming unbalanced.

Moreover, according to the present invention, the discharge electrodes of the voltage applying means are provided away from the web supported by the circumferential surface of the backup roller(s), so that the irregularity in the discharge can be prevented, unlike the conventional charge eliminating apparatus using the brush.

Furthermore, according to the present invention, plural fine wires are used so as to prevent the corona discharge from centering on the tip of the fine wire, unlike the conventional charge eliminating apparatus using the brush.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
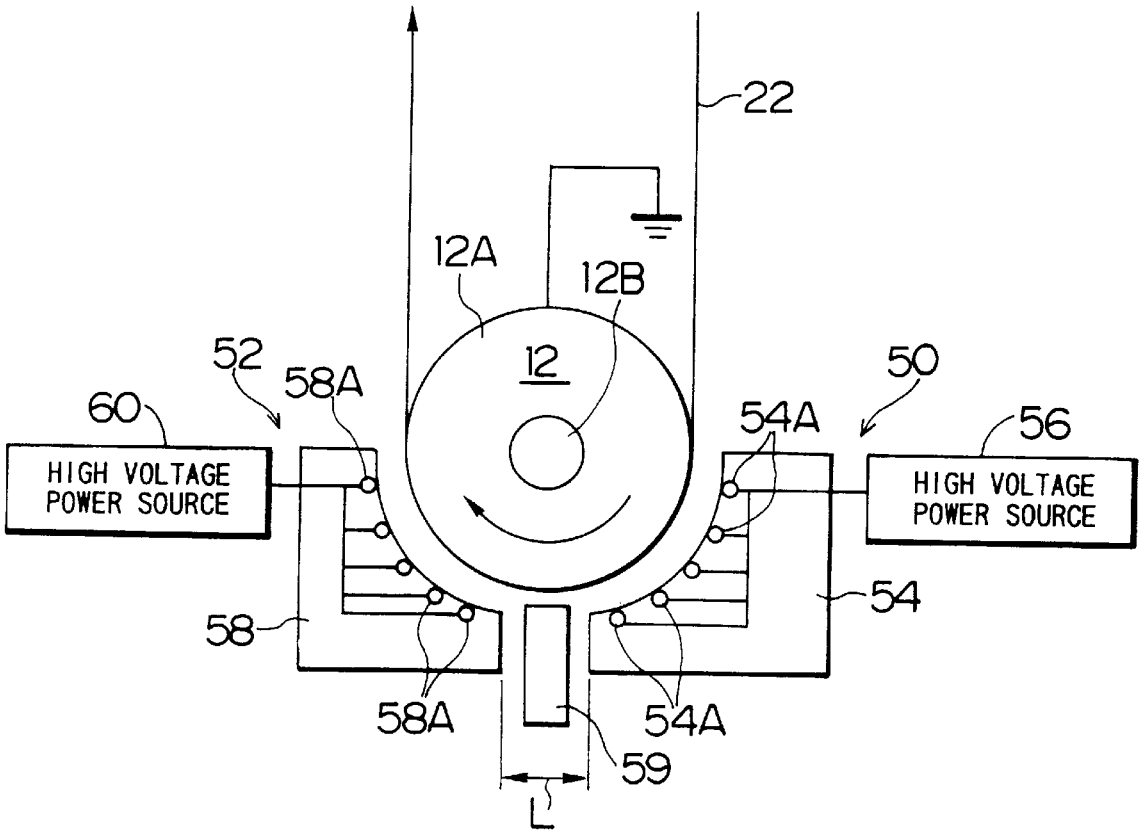
FIG. 1 is a diagram illustrating the charge eliminating apparatus for a moving web according to the first embodiment of the invention.

FIG. 1 is a diagram illustrating the construction of the first embodiment according to the present invention. A first voltage applicator 54 is provided at an upstream side 50 of a moving web 22, and a second voltage applicator 58 is provided at a downstream side 52 of the web 22. Discharge electrodes 54A, 54A . . . and 58A, 58A . . . of the voltage applicators 54 and 58 are arranged at uniform intervals with predetermined gaps against the web supported by the circumferential surface of a backup roller 12, which is rotatably supported in a state of being grounded. The distance L between the first voltage applicator 54 and the second voltage applicator 58 is settled to be small so as to prevent the charge potential of the web 22 from rising too high. As a result, the charge potential of the web can be prevented from rising abnormally, so the moving web does not draw the floating matter around itself electrostatically so that the floating matter can be prevented from adhering to the web.

Figure 7:
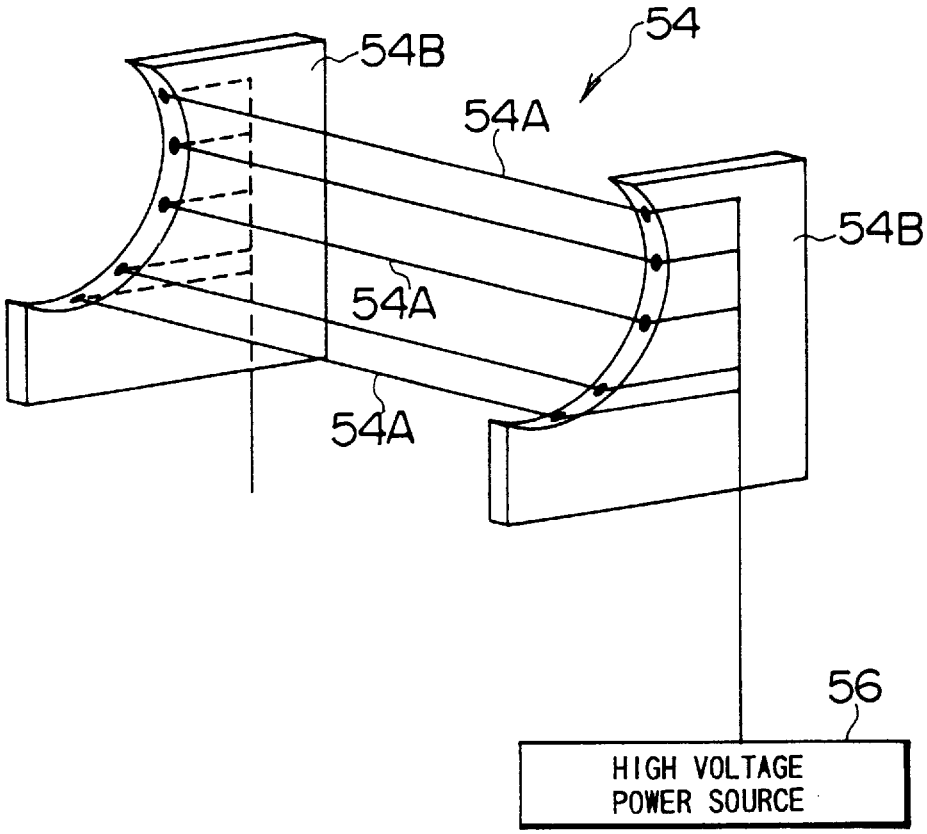
FIG. 7 is a diagram illustrating a voltage applicator which is adapted to the charge eliminating apparatus for the moving web according to the invention.

As shown in FIG. 1, the backup roller 12 is composed of a shell 12A and a shaft 12B. The shell 12A is rotatably supported by the shaft 12B, and it is grounded to the earth via the shaft 12B. The discharge electrodes 54A, 54A. . . and 58A, 58A . . . are composed of fine wires which are made of conductive material. FIG. 7 shows the discharge electrodes 54A, 54A . . . ; however, the discharge electrodes 58A, 58A . . . are constructed in a similar manner. The discharge electrodes are arranged parallel at uniform intervals with predetermined gaps against the moving web supported by circumferential surface of the backup roller 12. The discharge electrodes 54A, 54A . . . connect to the high voltage generating apparatus 56 and the discharge electrodes 58A, 58A . . . connect to the high voltage power source 60. Incidentally, the reference number 59 indicates an insulating plate.

Figure 2:
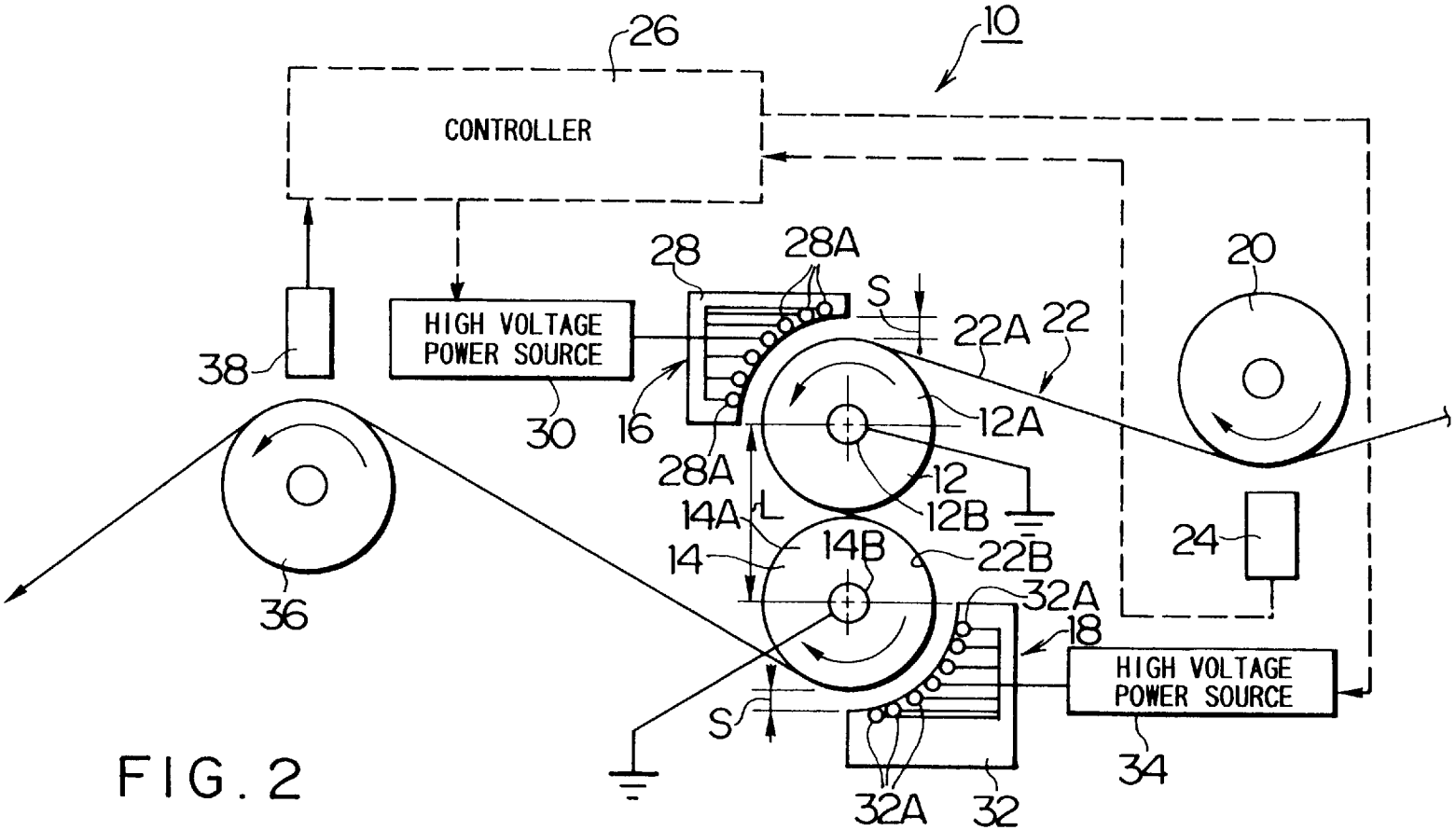
FIG. 2 is a diagram illustrating the charge eliminating apparatus for a moving web according to the second embodiment of the invention.

FIG. 2 is a diagram of the second embodiment according to the present invention. The second embodiment has a first backup roller 12, which supports the moving web 22 on one surface; discharge electrodes 28A, 28A . . . arranged at uniform intervals with predetermined gaps against another surface 22A of the web 22; a first voltage applicator 16 for applying D.C. voltage to the discharge electrodes 28A, 28A . . . so as to apply ions to the surface 22A of the web 22; a second backup roller 14 which is rotatably supported at the downstream side of the first backup roller 12 in a state of being grounded; and a second voltage applicator 18 for applying ions of the same polarity as the above-mentioned ions to the other surface 22B of the web 22, which is supported on the second backup roller 14, so as to eliminate the charge. The distance L between the first backup roller 12 and the second backup roller 14 is settled to be small to an extent that the first backup roller 12 and the second backup roller 14 do not contact each other, so that the electrostatic charge potential of the web can be prevented from rising too high.

The first backup roller 12 of the charge eliminating apparatus 10 has the shell 12A and the shaft 12B. The shell 12A is made of a steel material, which surface is plated with chromium, or aluminum material, and the shaft 12B is made of SUS 316. An aluminum roller, a carbon fiber roller, a ceramic-coated roller, a ceramic roller, or the like is used as the first backup roller 12.

Conductive oil is used as bearing oil of the first backup roller 12. The shell 12A is rotatably supported by the shaft 12B, and is grounded to the earth by the shaft 12B. The first backup roller 12 supports the web 22, which is transferred via a pass roller 20, toward the downstream. A charge potential meter 24 is arranged in such a manner to face the web 22 on the pass roller 20. The charge potential meter 24 measures the charge potential of the web 22. The measured charge potential is displayed by a controller 26.

A first voltage applicator 16 is provided close to the first backup roller 12. The first voltage applicator 16 comprises discharge electrodes 28 and is electrically connected to a high voltage power source 30, and the discharge electrodes 28 has a plurality of electric discharge electrodes 28A, 28A . . . A fine wire, which has a diameter of 0.1 mm and is made of a conductive member such as tungsten, carbon fiber, copper wire, stainless, etc., is used for the discharge electrode 28A. The discharge electrodes 28A, 28A . . . are arranged at uniform intervals with predetermined gaps against the web 22 supported on the circumferential surface of the first backup roller 12. Incidentally, the smaller the diameter of the discharge electrode 28A is, the better. However, the diameter of more than 10 $\mu$m is desirable because the discharge electrode of too small diameter is easy to break.

The discharge electrodes 28A, 28A . . . are arranged at uniform intervals with predetermined gaps S (approximately 10 mm) against the web 22 around the circumferential surface of the first backup roller 12. The first high voltage power source 30 electrically connects to the discharge electrodes 28A, 28A . . . . The first high voltage power source 30 supplies the positive or negative D.C. voltage to the discharge electrodes 28A, 28A . . . of the first voltage applicator 16, conforming to the instruction signals from the controller 26. As a result, the discharge electrodes perform the corona discharge of the positive or negative ions.

The second backup roller 14 is provided at the downstream side of the first backup roller 12. The second backup roller 14 has a shell 14A and a shaft 14B like the first backup roller 12. Both the shell 14A and the shaft 14B are made of conductive material, and the shaft 14A is made of SUS 316.

Conductive oil is used as bearing oil of the second backup roller 14 like the first backup roller 12. The shell 14A is rotatably supported by the shaft 14B, and is grounded to the earth via the shaft 14B. The second backup roller 14 supports the web 22, which is transferred via the first backup roller 12, toward the downstream.

A second voltage applicator 18 is provided close to the second backup roller 14. The second voltage applicator 18 comprises discharge electrodes 32 and is electrically connected to a high voltage power source 34. The discharge electrodes 32 has a plurality of discharge electrodes 32A, 32A . . . . A fine wire, which is the same as that of the discharge electrodes 28, is used for the discharge electrode 32A. The discharge electrodes 32A, 32A . . . are arranged at uniform intervals with predetermined gaps S (approximately 10 mm) against the web 22 supported on the circumferential surface of the second backup roller.

The second power source 34 electrically connects to the discharge electrodes 32A, 32A. . . . The second high voltage power source 34 supplies a positive or negative D.C. voltage to the discharge electrodes 32A, 32A . . . of the second voltage applicator 32, conforming to the instruction signals from the controller 26. As a result, the discharge electrodes 32A, 32A . . . generates the corona discharge and applying the positive or negative ions. Incidentally, the discharge electrodes 28A, 28A, . . . and 32A, 32A, . . . are constructed in the same manner as the discharge electrodes 54A, 54A, . . . in FIG. 7.

The distance L between the first voltage applicator 28 and the second voltage applicator 32 is settled to be extremely small. Therefore, while the web 22, which is supplied with the discharge ions by the first voltage applicator 28, is being transferred toward the second voltage applicator 32, the positive or negative ions supplied by the first voltage applicator 28 are prevented from becoming unbalanced. As a result, the electrostatic charge potential of the web can be prevented from becoming abnormally high. The charge potential of the web 22 is controlled to be low, and the web 22 does not draw the floating matter such as the dust in the air around itself.

A pass roller 36 is rotatably mounted at the downstream side of the second backup roller 14, and the web 22 is transferred to the pass roller 36 via the second backup roller 14. A charge potential meter 38 is provided in such a manner to face the web 22, and the charge potential meter 38 measures the ion on the web 22 and transmits it to the controller 26.

An explanation will hereunder be given about the operation of the charge eliminating apparatus for the web according to the present invention which is constructed in the above-mentioned manner.

First, the charge potential on the web 22 at the upstream is measured by the charge potential meter 24, which is provided in such a manner to face the web 22 on the pass roller 20, and the measurement result is transmitted to the controller 26. The controller 26 displays the electrostatic charge potential on a monitor (not shown) according to the charge potential transmitted from the charge potential meter 24. The controller 26 transmits a signal in order to apply the negative D.C. voltage to the first high voltage power source 30 electrically connected to the first voltage applicator 16. The first high voltage power source 30 supplies the negative D.C. voltage to the discharge electrodes 28A, 28A . . . of the first voltage applicator 16. As a result, the uniform negative ions are applied to the surface 22A of the web 22.

On the other hand, the charge potential of the web 22 at the downstream is measured by the charge potential meter 38, which faces the web 22 on the pass roller 36, and the measurement result is transmitted to the controller 26. The controller 26 transmits a signal to the second high voltage power source 34 of the second voltage applicator 18 so that the D.C. voltage is applied in such a manner that the charge potential of the web 22 becomes 0 V according to the charge potential transmitted from the charge potential meter 38. The second high voltage power source 34 supplies the negative D.C. voltage to the discharge electrodes 32A, 32A . . . of the second voltage applicator 18. Thus, the same quantity of the negative ion charges the other surface 22B and the surface 22A of the web 22, so that the charge of the web 22 can be eliminated.

In the second embodiment, the explanation was given of the case that the surface 22A of the web 22 is supplied with the positive or negative ions by the first voltage applicator 16, and then the back surface 22B of the web 22 is supplied with the ion of the same polarity as the electrostatic charge on the surface of the web 22, so that the charge on the web 22 can be eliminated. However, the present invention is not limited to this embodiment.

Figure 3:
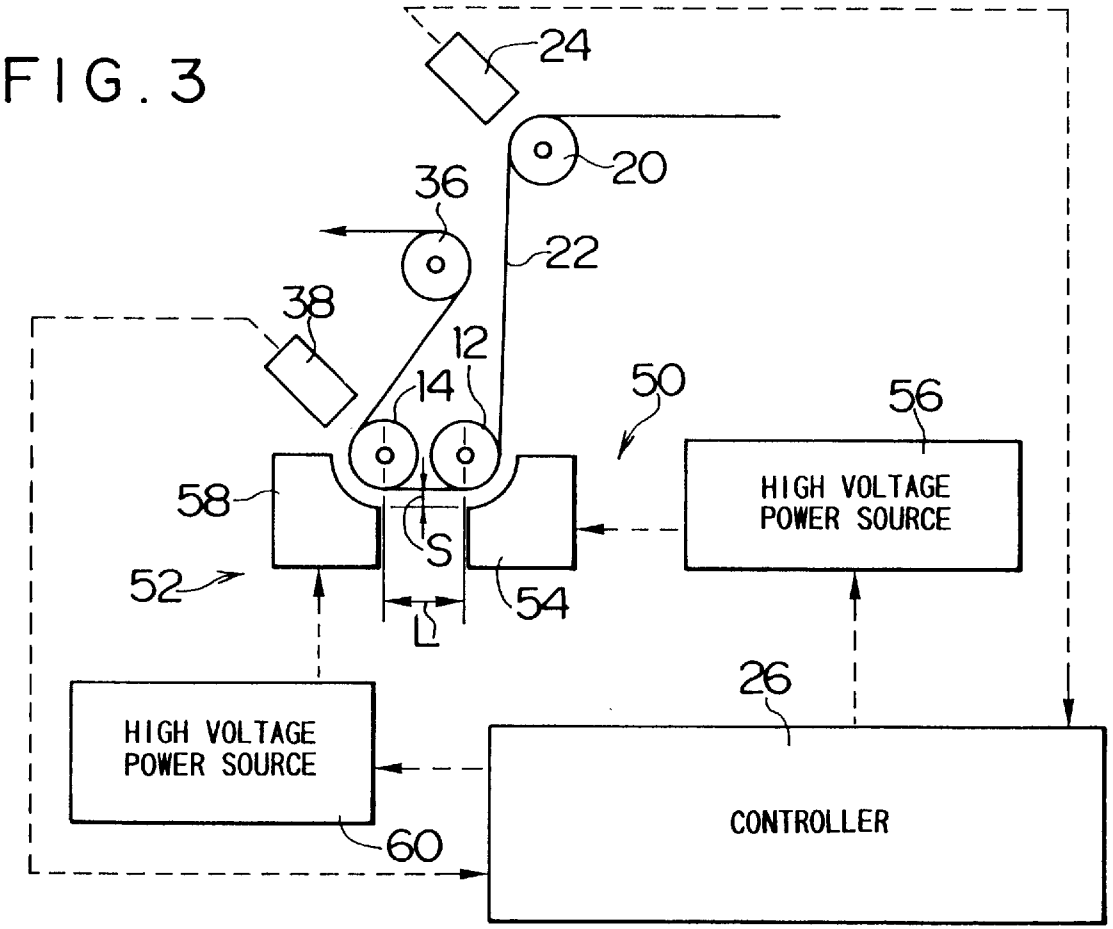
FIG. 3 is a diagram illustrating the charge eliminating apparatus for a moving web according to the third embodiment of the invention.
Figure 4:
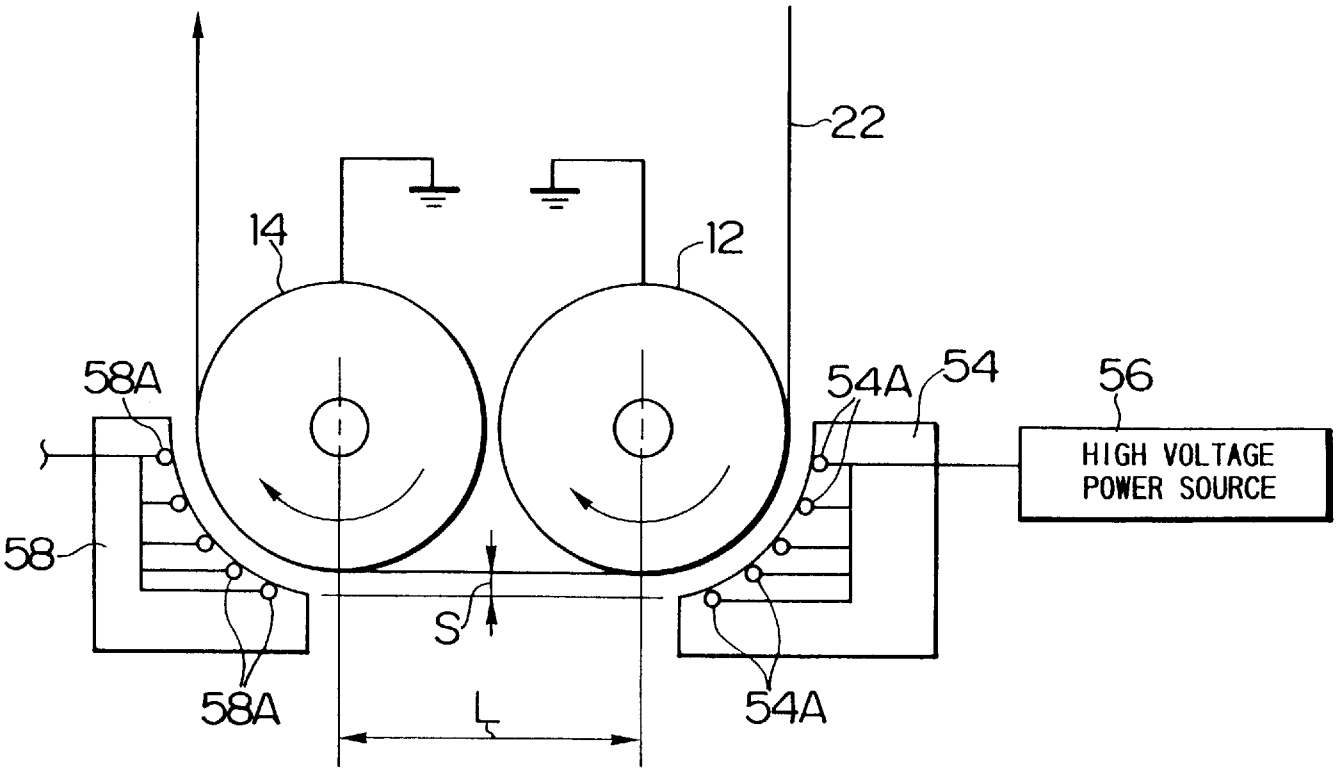
FIG. 4 is a diagram illustrating the charge eliminating apparatus for a moving web according to the third embodiment of the invention.

As for the third embodiment as shown in FIGS. 3 and 4, a first voltage applicator 50 charges only one surface of the web 22 with the positive ions, and a second voltage applicator 52 charges the same surface with the negative ions, so that the charge of the web 22 can be eliminated.

An explanation will hereunder be given about the third embodiment with reference to FIG. 3. Incidentally, the same reference numbers are designated on the same or similar members as those of the second embodiment in FIG. 2.

In the third embodiment, the first voltage applicator 50 and the second voltage applicator 52 are provided. The first voltage applicator 50 comprises discharge electrodes 54 and is electrically connected to a first high voltage power source 56. The discharge electrodes 54 is constructed in such a manner that discharge electrodes 54A, 54A . . . (see FIG. 4) are arranged in the same manner as the discharge electrodes 28 in the second embodiment. The discharge electrodes 54A, 54A . . . of the first voltage applicator 50 are arranged at uniform intervals with predetermined gaps S (approximately 10 mm) against the web 22 supported on the circumferential surface of the first backup roller 12. The first high voltage power source 56 electrically connects to the discharge electrodes 54A, 54A . . . . The first high voltage power source 56 supplies the high D.C. voltage to the discharge electrodes, conforming to the instruction signals from the controller 26. As a result, the corona discharge occurs in the discharge electrodes 54A, 54A . . . to generate the positive or negative ions.

The second voltage applicator 52 comprises discharge electrodes 58 and is electrically connected with a second high voltage power source 60. The discharge electrodes 58 is constructed in the same manner as the discharge electrodes 32 in the second embodiment. Discharge electrodes 58A, 58A . . . (see FIG. 4) of the second voltage applicator 52 are arranged at uniform intervals with predetermined gaps S (approximately 10 mm) against the web 22 supported on the circumferential surface of the second backup roller 14. The second high voltage power source 60 electrically connects to the discharge electrodes 58A, 58A . . . . The second high voltage power source 60 supplies a high D.C. voltage to the discharge electrodes 58A, 58A . . . . As a result, the corona discharge occurs in the discharge electrodes 58A, 58A . . . to generate the positive or negative ions.

An explanation will hereunder be given about the operation of the third embodiment.

First, the charge potential of the web 22 is measured by the charge potential meter 24, which is provided to face the web 22 on the pass roller 20, and the measurement result is transmitted to the controller 26. The controller 26 displays the charge potential on a monitor (not shown) according to the signal which is transmitted from the charge potential meter 24.

The controller 26 outputs a signal so as to supply D.C. voltage of 0–10 kV or −10–0 kV to the first high voltage power source 56 connected with the first voltage applicator 50. The first high voltage power source 56 supplies the D.C. voltage of −10–0 kV or 0–10 kV to the discharge electrodes 54A, 54A . . . of the first voltage applicator 50 according to the signal. As a result, the corona discharge occurs in the discharge electrodes 54A, 54A . . . , and the surface 22A of the web 22 is charged with the uniform positive or negative ions.

On the other hand, the charge potential of the web 22 is measured by a charge potential meter 38, which is located at a position of the second backup roller 14, and the measurement result is transmitted to the controller 26.

The controller 26 outputs a signal to the second high voltage power source 60, so that a D.C. voltage (−10–0 kV or 0–10 kV) is supplied in such a manner that the charge potential of the web 22 becomes 0 V, according to the charge potential transmitted from the charge potential meter 38. The second high voltage power source 60 supplies the D.C. voltage to the discharge electrodes 58A, 58A . . . of the second voltage applicator 52 according to the signal.

As a result, the surface 22A of the web 22 is applied with either positive ions or negative ions. Therefore, the positive or negative ions, which is applied to the surface 22A of the web 22 by the discharge electrodes 58A, 58A . . . , absorb the positive ions or negative ions of opposite polarity, so that the ions can be neutralized.

Figure 5:
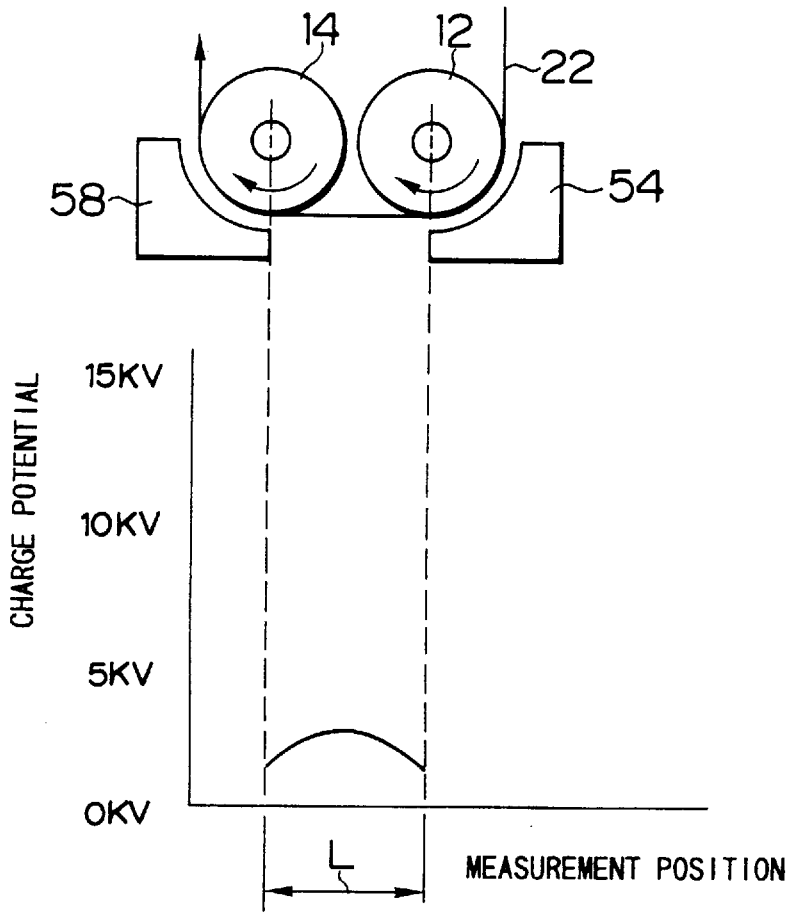
FIG. 5 is a diagram showing the effects of the third embodiment of the charge eliminating apparatus for the moving web according to the invention.
Figure 8:
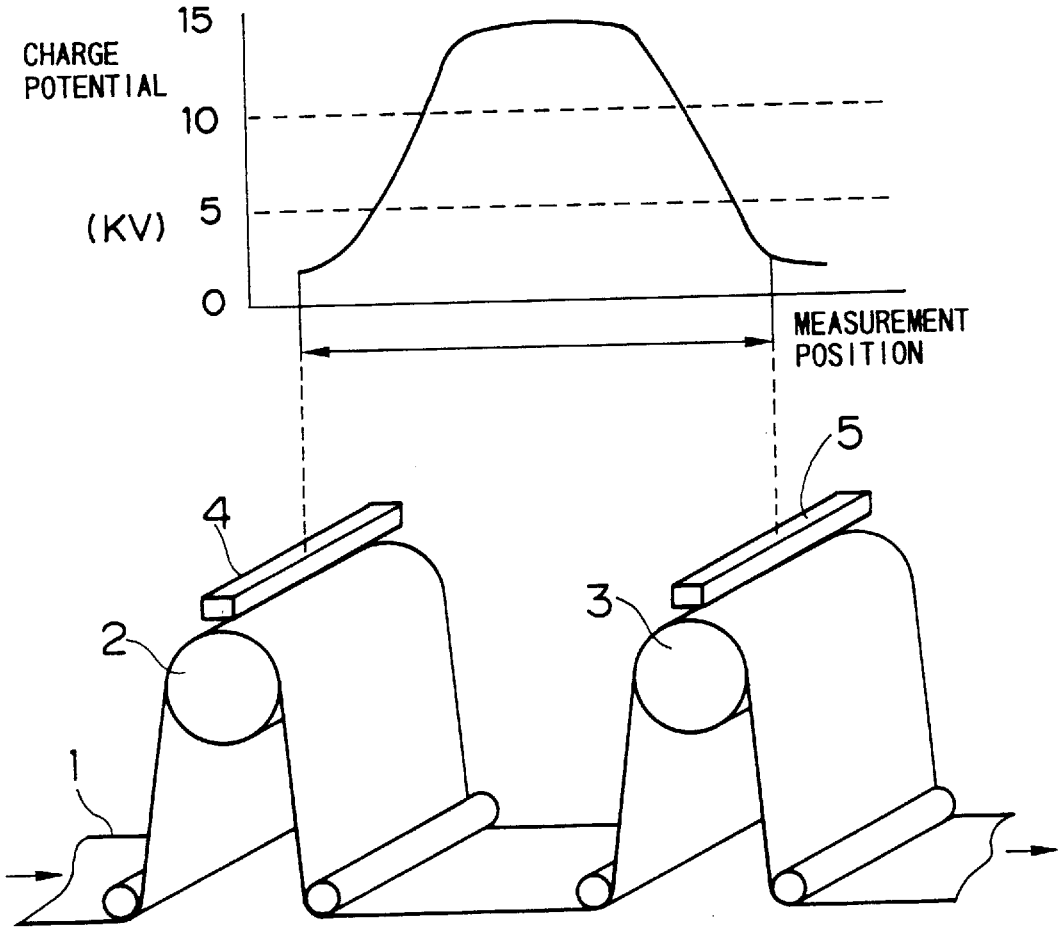
FIG. 8 PRIOR ART
FIG. 8 is a diagram showing the charge potential of the conventional charge eliminating apparatus.
Figure 9:
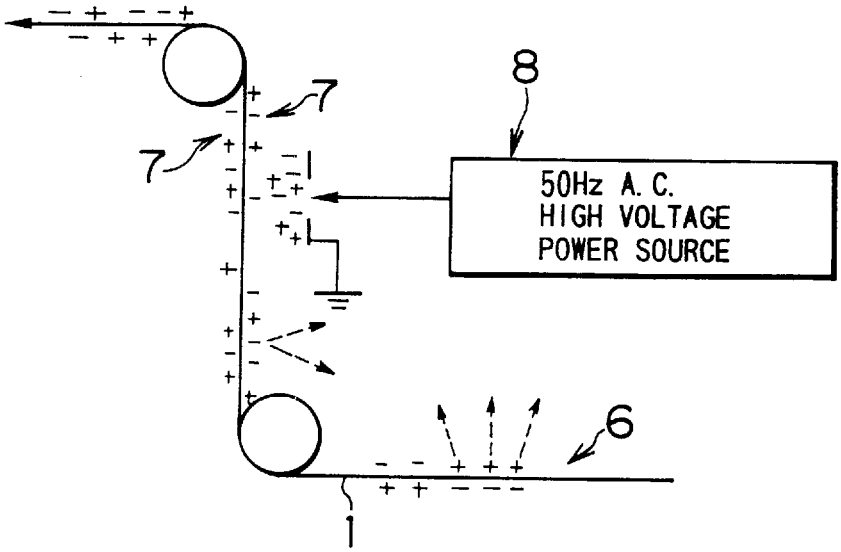
FIG. 9 PRIOR ART
FIG. 9 is a diagram showing the workings of the conventional charge eliminating apparatus.
Figure 10:
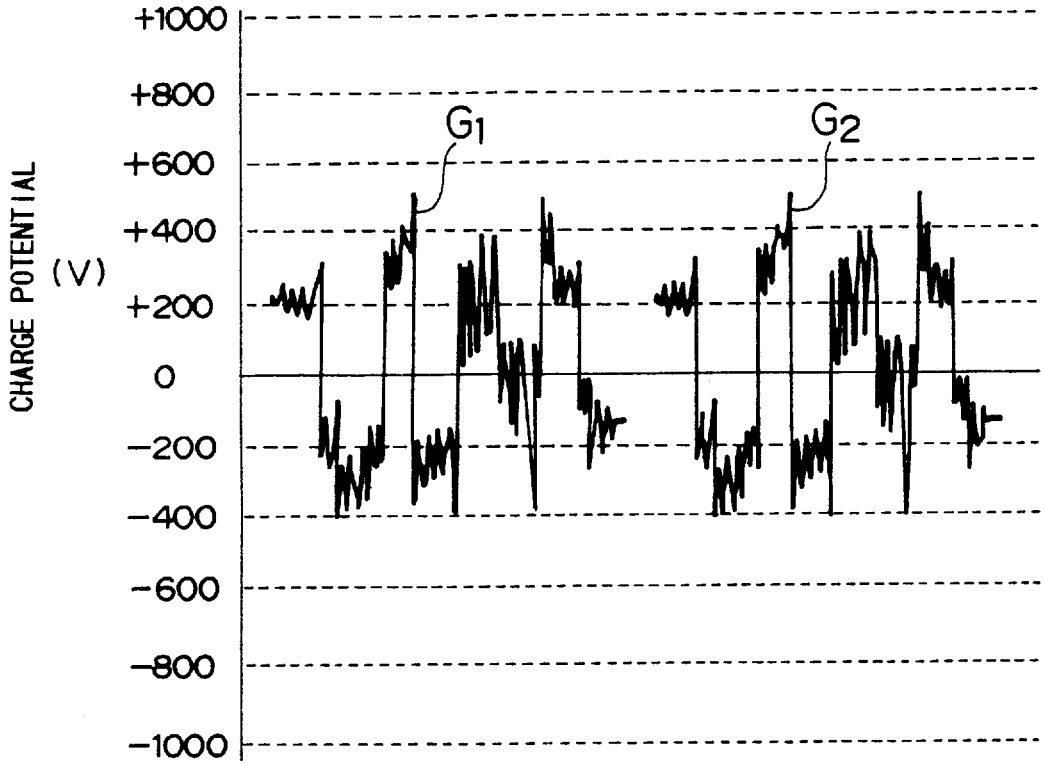
FIG. 10 PRIOR ART
FIG. 10 is a graph showing the electrostatic charge potential of the conventional charge eliminating apparatus.

In this case, the distance L between the first backup roller 12 and the second backup roller 14 is settled to be small, i.e. L≦5×diameter of backup roller is desirable, and in particular, the distance L is desired to be small to an extent that the first backup roller 12 and the second backup roller 14 do not contact each other. Therefore, the positive or negative ions applied to the web 22 by the first voltage applicator 50 can be prevented from becoming unbalanced while the web moves from first backup roller to the second backup roller. In the prior art as shown in FIG. 8, the distance between the backup rollers 2 and 3 of the web 1 is so large that the charge potential of the web 1 can rise abnormally high. In the present invention, because the distance is small as shown in FIG. 5, the charge potential of the web 22 is controlled to be low, and the web 22 does not draw the floating matter in the air around itself electrostatically, so that the floating matter does not adhere to the web 22. Of course, the charge potential meter 38 and the controller 26 may be adapted to the first embodiment in FIG. 1. In this case, the charge potential meter 38 is arranged at the downstream side of the backup roller 14. The controller 26 controls the voltage supplied to the discharge electrodes 58A, 58A . . . of the second voltage applicator 52 so that the charge potential of the web 22, which is measured by the charge potential meter 38, becomes to zero.

FIG. 7 is a perspective view showing a structure of the voltage applicators 54, 58, 16, and 18 (FIG. 7 shows the voltage applicator 54 only) which are adapted to the first, second and third embodiments of the present invention. As shown in FIG. 7, the voltage applicator 54 is constructed in such a manner that a plurality of discharge electrodes 54A, 54A . . . , which are composed of fine wires made of conductive material, are stretched between the two insulating plates 54B and 54B. The two insulating plates 54B and 54B are arranged at a distance, which is substantially equal to the width of a backup roller (not shown). As a result, if the positive or negative D.C. voltage is supplied to the discharge electrodes 54A, 54A . . . by the high voltage power source 56, the positive or negative ions are corona-discharged toward the web supported on the backup roller via the discharge electrodes 54A, 54A . . . .

EXAMPLE

Polyethylene terephthalete film, which has a width of approximately 1 m and a thickness of 175 μm, is transferred as the web 22 at a speed of 100 m/m, so that the charge is eliminated by the charge eliminating apparatus in FIG. 2.

The backup rollers 12 and 14 are constructed in such a manner that the shell material is aluminum coated with the hard chrominium, and the shaft material is the SUS 316 having an outer diameter of 80 mm. The conductive oil is used as the bearing oil of the backup roller, and the earth resistance is less than 10 KΩ.

The first voltage applicator 28 and the second voltage applicator 32 used tungsten wires as the discharge electrodes 28A and 32A. Seven wires were coaxially arranged at uniform intervals of 10 mm with the gaps of 10 mm away from each surface of the backup rollers 12 and 14. The discharge electrodes were fixed by the insulating material (teflon), and the voltage was supplied to them.

Figure 6:
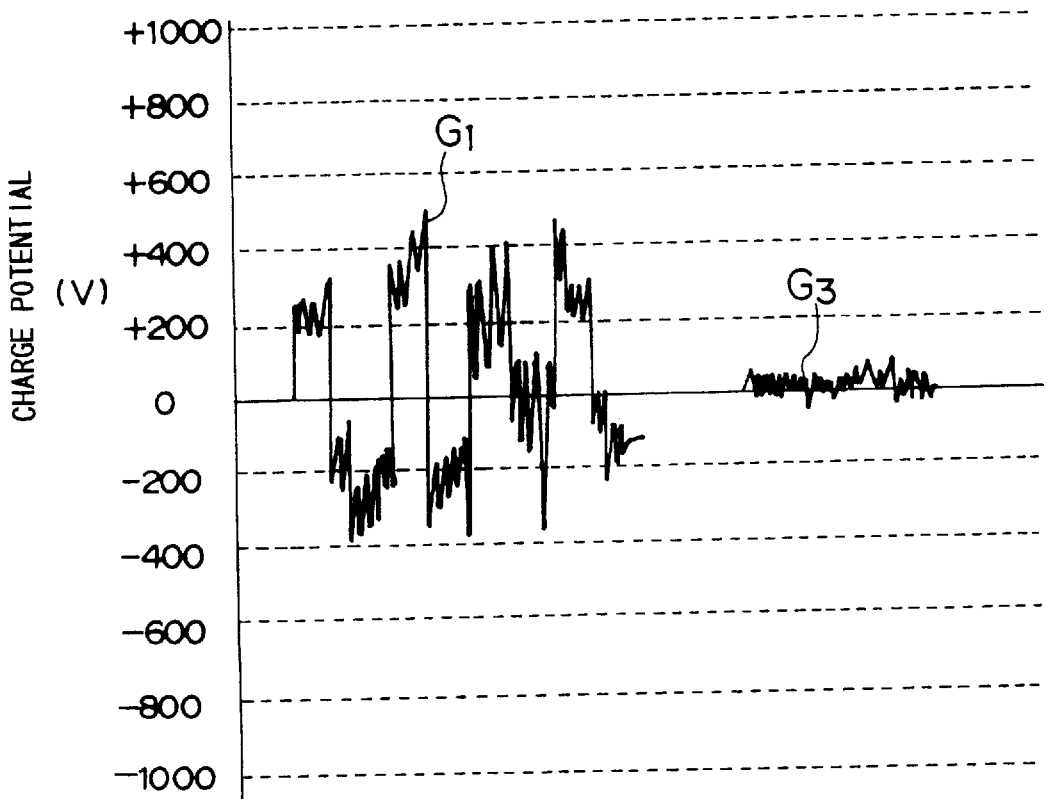
FIG. 6 is a graph showing the effects of the second embodiment of the charge eliminating apparatus for the moving web according to the invention.

The first voltage applicator 28 supplied to the voltage of −7 kV, and the second voltage applicator 32 supplied the voltage of −6.5 kV. When the distance L between the first voltage applicator 28 and the second voltage applicator 32 was settled to be 150 mm (<5×80 mm), the charge elimination was remarkably effective as shown in FIG. 6. That is, in FIG. 6, the graph $G_1$ shows the charge potential of the web before charge elimination, and the graph $G_3$ shows the charge potential of the web after charge elimination.

In the above-described embodiment, the explanation was given about the case when the fine wires made of the conductive material were used as the discharge electrodes of the first voltage applicator 28 and the second voltage applicator 32. The wires are made of tungsten, carbon fiber, copper wire, stainless steel, and the like. However, the present invention is not limited to these. The discharge electrodes such as metal plates, knife edges, etc. may be used to achieve the same effects.

In the above-described embodiment, the explanation was also given about the case when the web is supplied with the negative ions. However, the present invention is not limited to this embodiment. The web 22 may be supplied with the positive ions so as to achieve the same effects. In this case, the first voltage applicator 16 supplies the web 22 with the positive ions, and the second voltage applicator 18 supplies the web 22 with the positive ions, so that the ions can be neutralized (0 V).

Furthermore, although the explanation was given about the case when −7 kV is supplied to the discharge electrodes 28A, 28A, the present invention is not limited to this example. The voltage, which is supplied to the discharge electrodes 28A, 28A . . . of the first voltage applicator 28, may be adjusted according to the charge potential of the web 22, which is measured by the charge potential meter 24.

As has been described above, according to the charge eliminating apparatus for the moving web of the present invention, the discharge electrodes of both the first voltage applicator and the second voltage applicator are arranged at uniform intervals with predetermined gaps against the web supported by the circumferential surface of the backup roller. A pair of the voltage applying means are provided so that the ion can be neutralized and the charge of the web can be reduced efficiently.

Moreover, according to the present invention, the distance between the first voltage applicator and the second voltage applicator is settled to be small so as to prevent the charge potential of the web from rising too high. When the web is transferred from the first voltage applying means to the second voltage applying means, the positive or negative ions, which are supplied to the web by the first voltage applying means, can be prevented from becoming unbalanced. As a result, the charge potential of the web can be prevented from rising abnormally, so the moving web does not draw electrostatically the floating matter around itself so that the floating matter can be prevented from adhering to the web. Incidentally, the distance between the first voltage applying means and the second voltage applying means is small whereby saving much space.

According to the present invention, the discharge electrodes of the first voltage applying means and the second voltage applying means are disposed away from the circumferential surface of the backup roller, and the fine wires are used unlike the conventional charge eliminating apparatus using the brush, so that the irregularity in the corona discharge can be prevented. Moreover, a plurality of the fine wires are away from the circumferential surface of the backup roller, so that the corona discharge can be prevented from centering on the tip of the fine wire. As a result, the corrosion and the deterioration of the fine wires can be prevented, so that the durability of the fine wires can be improved. Furthermore, since the dust does not adhere to the tips of the fine wires, there is no need to care for the apparatus frequently.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A charge eliminating apparatus for a moving web comprising:

an electrically grounded, cylindrical backup roller rotatably mounted for supporting the moving web, a first voltage applying means having at least three discharge electrodes arranged at uniform intervals with predetermined gaps of about 10 mm relative to the moving web, and a second voltage applying means having at least three discharge electrodes arranged at uniform intervals with predetermined gaps of about 10 mm relative to the moving web;

wherein each said discharge electrode is positioned such that it is parallel to an exterior cylindrical surface of the backup roller;

wherein the distance between the first voltage applying means and the second voltage applying means is small in the vicinity of said backup roller to prevent the charge potential of the moving web from rising too high.

2. The charge eliminating apparatus as claimed in claim 1, wherein said distance is equal to or smaller than the diameter of the backup roller.

3. The charge eliminating apparatus as claimed in claim 1, wherein said discharge electrodes are composed of fine wires.

4. The charge eliminating apparatus as claimed in claim 3, further comprising:

an insulating means provided between the first voltage applying means and the second voltage applying means, and two high voltage power sources supplying D.C. voltage to both first and second voltage applying means.

5. A charge eliminating apparatus for a moving web comprising:

an electrically grounded, cylindrical first backup roller rotatably mounted for supporting the moving web on a first surface thereof, a first voltage applying means having at least three discharge electrodes arranged at uniform intervals with predetermined gaps of about 10 mm relative to the moving web, an electrically grounded, cylindrical second backup roller rotatably mounted for supporting the moving web on a second, opposite surface of the moving web, and a second voltage applying means having at least three discharge electrodes arranged at uniform intervals with predetermined gaps of about 10 mm relative to the moving web;

wherein the distance between the first voltage applying means and the second voltage applying means is small in the vicinity of said each backup roller to prevent the charge potential of the moving web from rising too high.

6. The charge eliminating apparatus as claimed in claim 5, wherein said distance is equal to or smaller than 5 times the diameter of any of the first backup roller or the second backup roller.

7. The charge eliminating apparatus as claimed in claim 5, wherein said discharge electrodes are composed of fine wires positioned such that the wires are parallel to an exterior cylindrical surface of the backup rollers.

8. The charge eliminating apparatus as claimed in claim 5, further comprising:

a charge potential measuring means for measuring charge potential of the moving web provided downstream of the second backup roller, two high voltage power sources supplying D.C. voltage to both first and second voltage applying means, and a control means for controlling the D.C. voltage supplied from one of the two high voltage power sources to the second voltage applying means so that charge potential of the moving web measured by the measuring means becomes to zero volt.

9. A charge eliminating apparatus for a moving web comprising:

an electrically grounded, cylindrical first backup roller rotatably mounted for supporting the moving web on a first surface thereof, a first voltage applying means having at least three discharge electrodes arranged at uniform intervals with predetermined gaps of about 10 mm relative to the moving web for applying positive or negative ions to a second, opposite surface of the moving web, an electrically grounded, cylindrical second backup roller rotatably mounted for supporting the moving web on the first surface thereof, and a second voltage applying means having at least three discharge electrodes arranged at uniform intervals with predetermined gaps of about 10 mm relative to the moving web for eliminating the positive or negative ions from said second moving web surface;

wherein each said discharge electrode is positioned such that it is parallel to an exterior cylindrical surface of the backup rollers;

wherein the distance between the first voltage applying means and the second voltage applying means is small in the vicinity of said each backup roller to prevent the charge potential of the web from rising too high.

10. The charge eliminating apparatus as claimed in claim 9, wherein said distance is equal to or smaller than 5 times the diameter of any of the first backup roller or the second backup roller.

11. The charge eliminating apparatus as claimed in claim 9, wherein said discharge electrodes are composed of fine wires.

12. The charge eliminating apparatus as claimed in claim 9, further comprising:

a charge potential measuring means for measuring charge potential of the moving web provided downstream of the second backup roller, two high voltage power sources supplying D.C. voltage to both first and second voltage applying means, and a control means for controlling the D.C. voltage supplied from one of the two high voltage power sources to the second voltage applying means so that charge potential of the moving web measured by the measuring means becomes to zero volt.

13. A charge eliminating apparatus for a moving web comprising:

an electrically grounded, cylindrical backup roller rotatably mounted for supporting the moving web on a first surface thereof, a first voltage applying means having at least three discharge electrodes arranged at uniform intervals with predetermined gaps of about 10 mm relative to the moving web for applying positive or negative ions to a second, opposite surface of the moving web, a second voltage applying means having at least three discharge electrodes arranged at uniform intervals with predetermined gaps of about 10 mm relative to the moving web for eliminating positive or negative ions from the second, opposite web surface;

wherein each said discharge electrode is positioned such that it is parallel to an exterior cylindrical surface of said backup roller;

wherein the distance between the first voltage applying means and the second voltage applying means is small in the vicinity of said backup roller to prevent the charge potential of the web from rising too high.

14. The charge eliminating apparatus as claimed in claim 13, wherein said distance is equal to or smaller than the diameter of the backup roller.

15. The charge eliminating apparatus as claimed in claim 13, wherein said discharge electrodes are composed of fine wires.

16. The charge eliminating apparatus as claimed in claim 15, further comprising:

an insulating means provided between the first voltage applying means and the second voltage applying means, and two high voltage power sources supplying D.C. voltage to both first and second voltage applying means.

17. The charge eliminating apparatus as claimed in claim 15, further comprising:

a charge potential measuring means for measuring charge potential of the moving web provided downstream of the backup roller, two high voltage power sources supplying D.C. voltage to both first and second voltage applying means, and a control means for controlling the D.C. voltage supplied from one of the two high voltage power sources to the second voltage applying means so that charge potential of the moving web measured by the measuring means becomes to zero volt.

* * * * *